US006401928B1

(12) United States Patent
Horton

(10) Patent No.: US 6,401,928 B1
(45) Date of Patent: Jun. 11, 2002

(54) CHRISTMAS DECORATION ORGANIZER

(76) Inventor: Helene Horton, P.O. Box 1315, Arizona City, AZ (US) 85223

( * ) Notice: Subject to any disclaimer, the term of this patent is extended or adjusted under 35 U.S.C. 154(b) by 0 days.

(21) Appl. No.: 09/625,453

(22) Filed: Jul. 26, 2000

(51) Int. Cl.[7] ..... B65D 21/02

(52) U.S. Cl. ..... 206/575; 206/419; 206/499; 206/511

(58) Field of Search ..... 150/111; 190/16, 190/108; 206/216, 223, 388, 419, 499, 511, 526, 575; 220/4.27, 23.83

(56) References Cited

U.S. PATENT DOCUMENTS 1,061,374 A * 5/1913 Harrington ..... 190/16
4,437,713 A * 3/1984 Roach ..... 206/526
4,619,363 A * 10/1986 Wolfseder ..... 220/4.27
5,033,619 A * 7/1991 Garis ..... 206/419
5,501,338 A * 3/1996 Preston ..... 206/499
5,653,339 A * 8/1997 Dobson ..... 206/419
5,941,388 A * 8/1999 Spielberger ..... 206/419
5,950,828 A * 9/1999 Bal ..... 220/4.27
6,053,322 A * 4/2000 Kim et al. ..... 206/575
6,105,774 A * 8/2000 Jackson ..... 206/499

* cited by examiner

*Primary Examiner*—Jim Foster
(74) *Attorney, Agent, or Firm*—Joseph N. Breaux

(57) ABSTRACT

A Christmas decoration organizer that includes a number of storage trays and boxes that are configured by the user to accommodate the user's specific decorations and which are then stacked one atop the other and secured by a securing mechanism with a handle to allow for easy transporting and storage of the decorations.

1 Claim, 4 Drawing Sheets

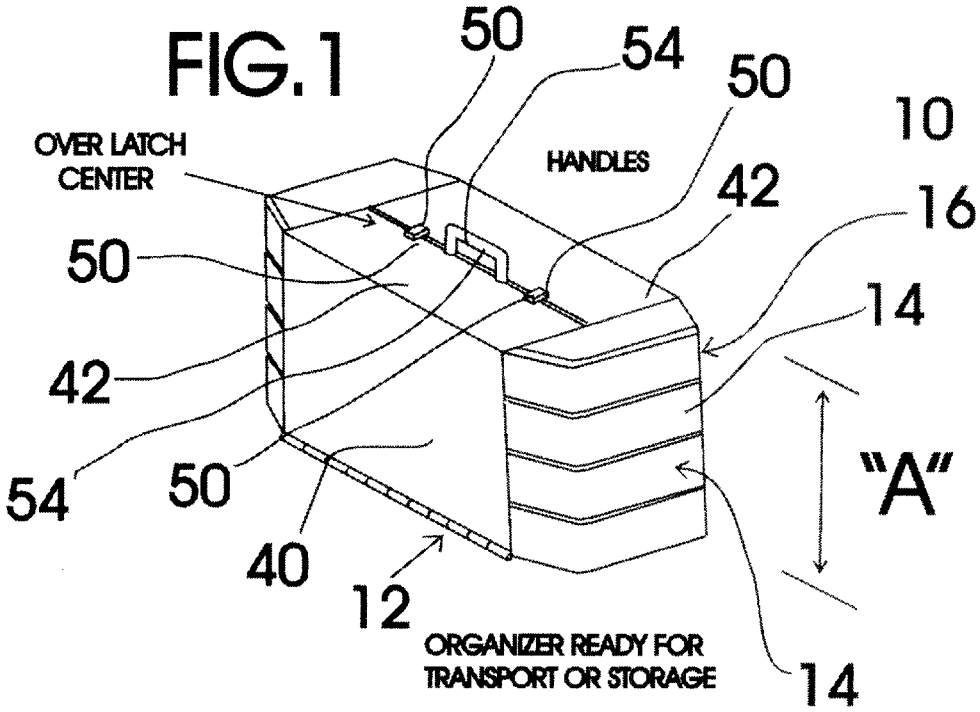
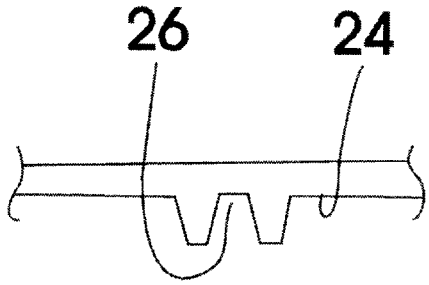
FIG. 2a

FIG.5
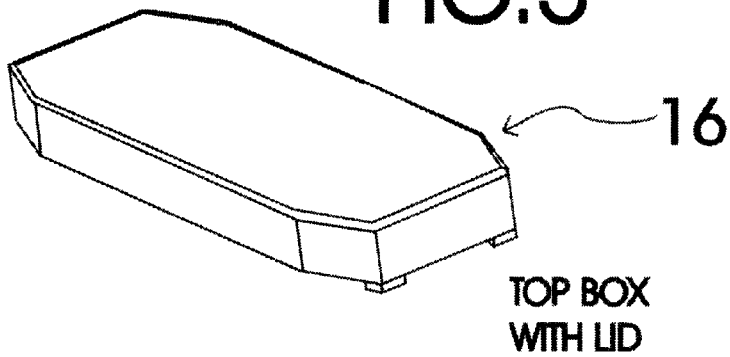
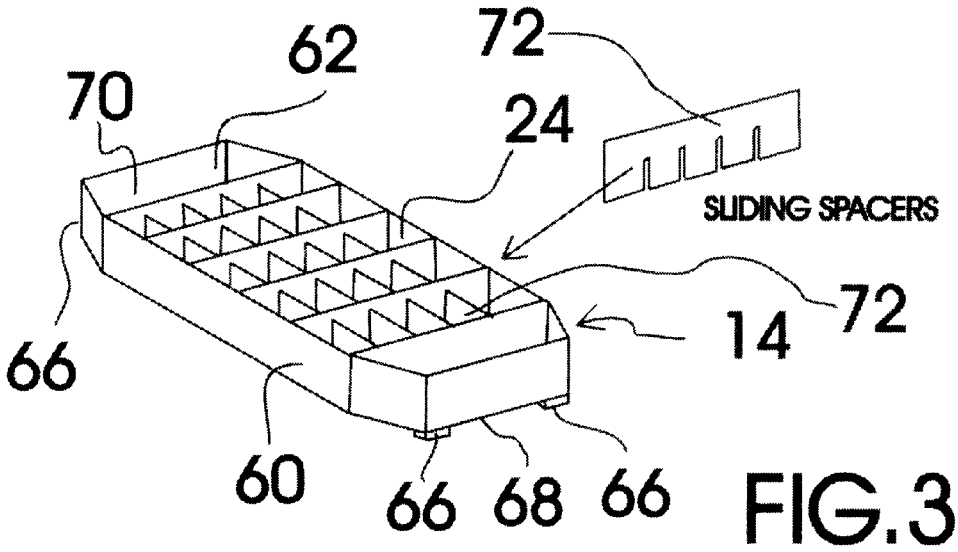
FIG.3

CHRISTMAS DECORATION ORGANIZER

TECHNICAL FIELD

The present invention relates to storage systems and more particularly to a Christmas decoration organizer for storing Christmas decorations such as tree ornaments, lights, garlands etc. between uses that includes a bottom box assembly, a number of stackable box assemblies and a top box assembly; the bottom box assembly including a bottom box structure defining a bottom box cavity having sidewalls provided with a number of parallel divider retaining channels, a number of bottom box cavity divider members that connect with the divider retaining channels and intersect each other when installed within the bottom box cavity to form a number of separated compartments for storing decorations, a bottom edge of each of two opposed sidewalls having a continuous box connecting hinge provide along the length thereof that is connected to a substantially rigid planar side flap having a rigid top flap hingedly connected to a side thereof opposite the box connecting hinge, each top flap being of a width equal to half the width of bottom box structure and including a fastener assembly for connecting with the fastener assembly of the other top flap when the two top flaps are folded down into the closed position, each top flap further including a handle member that is positioned directly adjacent to the handle member of the other top flap when the two top flaps are folded down into the closed position; each of the stackable box assemblies including a tray structure defining a storage compartment having sidewalls having a number of parallel divider retaining structures, a number of mating feet extending from a bottom surface thereof sized and positioned to seat against the interior top edge of a box assembly positioned below it, and a number of user moveable divider members wherein some of the divider members provided include opposed side indentations for allowing a string of Christmas lights or a garland to be wound therearound prior to inserting the ends of the divider member into two opposed parallel divider retaining structures; a lid member securable over the top of an uppermost stackable box assembly; the stackable box assemblies being stackable atop each other and the bottom box structure to a height equal to the height of the two rigid side flaps.

BACKGROUND ART

Decorating for Christmas can be both an enjoyable and a frustrating experience. The experience can be frustrating because the Christmas decorations can become lost, broken, tangled or the like making decorating more work then is necessary. It would be desirable, therefore, to have a Christmas decoration organizer that could provide a number of storage trays and boxes that could be configured by the user to accommodate the user's specific decorations and which could then be stacked one atop the other and secured by a securing mechanism with a handle to allow for easy transporting and storage of the decorations.

GENERAL SUMMARY DISCUSSION OF INVENTION

It is thus an object of the invention to provide a Christmas deoration organizer that includes a bottom box assembly, a number of stackable box assemblies and a top box assembly; the bottom box assembly including a bottom box structure defining a bottom box cavity having sidewalls provided with a number of parallel divider retaining channels, a number of bottom box cavity divider members that connect with the divider retaining channels and intersect each other when installed within the bottom box cavity to form a number of separated compartments for storing decorations, a bottom edge of each of two opposed sidewalls having a continuous box connecting hinge provide along the length thereof that is connected to a substantially rigid planar side flap having a rigid top flap hingedly connected to a side thereof opposite the box connecting hinge, each top flap being of a width equal to half the width of bottom box structure and including a fastener assembly for connecting with the fastener assembly of the other top flap when the two top flaps are folded down into the closed position, each top flap further including a handle member that is positioned directly adjacent to the handle member of the other top flap when the two top flaps are folded down into the closed position; each of the stackable box assemblies including a tray structure defining a storage compartment having sidewalls having a number of parallel divider retaining structures, a number of mating feet extending from a bottom surface thereof sized and positioned to seat against the interior top edge of a box assembly positioned below it, and a number of user moveable divider members wherein some of the divider members provided include opposed side indentations for allowing a string of Christmas lights or a garland to be wound therearound prior to inserting the ends of the divider member into two opposed parallel divider retaining structures; a lid member securable over the top of an uppermost stackable box assembly; the stackable box assemblies being stackable atop each other and the bottom box structure to a height equal to the height of the two rigid side flaps.

Accordingly, a Christmas decoration organizer is provided. The Christmas decoration organizer includes a bottom box assembly, a number of stackable box assemblies and a top box assembly; the bottom box assembly including a bottom box structure defining a bottom box cavity having sidewalls provided with a number of parallel divider retaining channels, a number of bottom box cavity divider members that connect with the divider retaining channels and intersect each other when installed within the bottom box cavity to form a number of separated compartments for storing decorations, a bottom edge of each of two opposed sidewalls having a continuous box connecting hinge provide along the length thereof that is connected to a substantially rigid planar side flap having a rigid top flap hingedly connected to a side thereof opposite the box connecting hinge, each top flap being of a width equal to half the width of bottom box structure and including a fastener assembly for connecting with the fastener assembly of the other top flap when the two top flaps are folded down into the closed position, each top flap further including a handle member that is positioned directly adjacent to the handle member of the other top flap when the two top flaps are folded down into the closed position; each of the stackable box assemblies including a tray structure defining a storage compartment having sidewalls having a number of parallel divider retaining structures, a number of mating feet extending from a bottom surface thereof sized and positioned to seat against the interior top edge of a box assembly positioned below it, and a number of user moveable divider members wherein some of the divider members provided include opposed side indentations for allowing a string of Christmas lights or a garland to be wound therearound prior to inserting the ends of the divider member into two opposed parallel divider retaining structures; a lid member securable over the top of an uppermost stackable box assembly; the stackable box assemblies being stackable atop each other and the bottom box structure to a height equal to the height of the two rigid side flaps.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the Christmas decoration organizer of the present invention.

FIG. 2*a* is a top plan view showing one of the numerous parallel divider retaining channels provided on the bottom box cavity sidewalls and the tray sidewalls.

FIG. 3 is a perspective view showing one of the number of stackable box, assemblies showing two of the four mating feet extending from a bottom surface thereof and a number of the user moveable divider members.

FIG. 5 is a perspective view showing the lid member securable over the top of an uppermost stackable box assembly.

EXEMPLARY MODE FOR CARRYING OUT THE INVENTION

Figure 2:
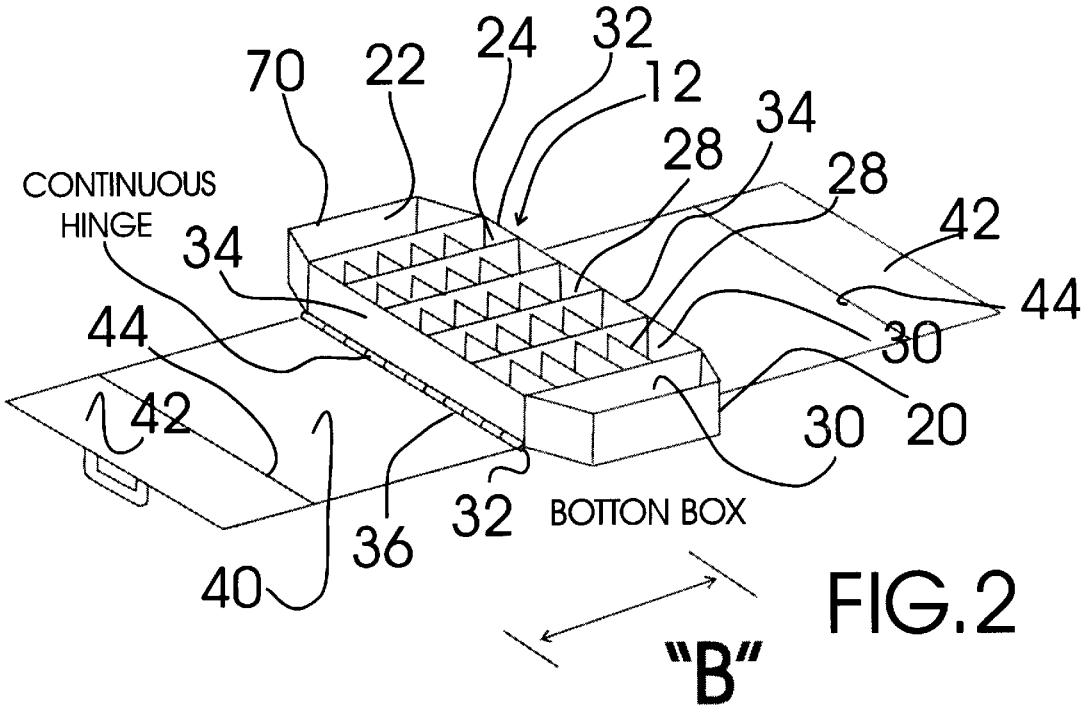
FIG. 2 is a perspective view of the bottom box assembly showing the two rigid planar side flaps folded out.
Figure 4:
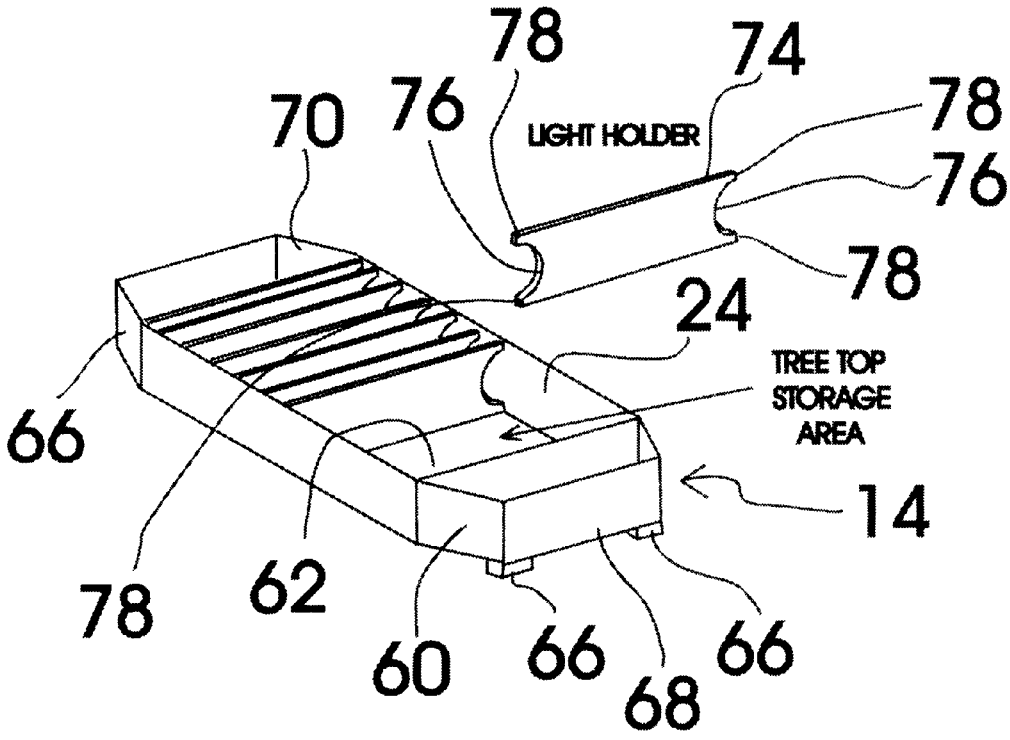
FIG. 4 is a perspective view showing another one of the number of stackable box assemblies showing a number of user moveable divider members provided with opposed side indentations for allowing a string of Christmas lights or a garland to be wound therearound prior to inserting the ends of the divider member into two opposed parallel divider retaining structures.

FIGS. 1–5 show various aspects of an exemplary embodiment of the Christmas decoration organizer of the present invention generally designated 10. Christmas decoration organizer 10 includes a bottom box assembly, generally designated 12; a number of stackable box assemblies, each generally designated 14; and a top box assembly, generally designated 16.

Bottom box assembly 12 is constructed from rigid molded plastic and includes a bottom box structure, generally designated 20, defining a bottom box cavity 22 having sidewalls 24 provided with a number of parallel divider retaining channels 26, a number of bottom box cavity divider members 28 that connect with the divider retaining channels 26 and intersect each other when installed within bottom box cavity 22 to form a number of separated compartments 30 for storing decorations. A bottom edge 32 of each of two opposed sidewalls 34 each have a continuous box connecting hinge 36 provide along the length thereof that is connected to a substantially rigid planar pivoting side flap 40 having a rigid top flap 42 hingedly connected to a side edge 44 thereof that is opposite box connecting hinge 36. Each top flap 42 is of a width equal to half the width of bottom box structure 20 and includes two fastener assemblies 50 for connecting with the two fastener assemblies 50 of the other top flap 42 when the two top flaps 42 are folded down into the closed position (shown in FIG. 1). Each top flap 42 also includes a handle member 54 that are positioned directly adjacent to the handle member 54 of the other top flap 42 when the two top flaps 42 are folded down into the closed position (shown in FIG. 1).

Each of the stackable box assemblies 14 is constructed from rigid plastic and includes a tray structure 60 defining a storage compartment 62 having sidewalls 24 having a number of parallel divider retaining structures 26 (shown in FIG. 2*a*), four mating feet 66 (one at each corner) extending from a bottom surface 68 thereof sized and positioned to seat against the interior top edge 70 of a box assembly 20 or tray structure 60 positioned below it, and a number of user moveable divider members 72,74. Divider members 74 are provided opposed side indentations 76 for allowing a string of Christmas lights or a garland to be wound therearound prior to inserting the ends 78 of divider member 74 into two opposed parallel divider retaining structures 26. Lid member 16 is securable over the top of an uppermost stackable box assembly 14.

Once the stackable box assemblies 14 are stacked atop each other and onto the bottom box structure 20, lid member 16 is positioned into place and the two rigid side flaps 40 are folded upward and top flaps 42 folded over lid member 16 and secured with fasteners 50. The height "A" of box assemblies 14, bottom box structure 20 and lid member 16 is equal to the height "B" of each of the rigid side flaps 40.

It can be seen from the preceding description that a Christmas decoration organizer has been provided that includes It is noted that the embodiment of the Christmas decoration organizer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Christmas decoration organizer comprising:

a bottom box assembly;

a number of stackable box assemblies; and a top box assembly;

said bottom box assembly including a bottom box structure defining a bottom box cavity having sidewalls provided with a number of parallel divider retaining channels, a number of bottom box cavity divider members that connect with said divider retaining channels and intersect each other when installed within said bottom box cavity to form a number of separated compartments for storing decorations, a bottom edge of each of two opposed sidewalls having a continuous box connecting hinge provide along said length thereof that is connected to a substantially rigid planar side flap having a rigid top flap hingedly connected to a side thereof opposite said box connecting hinge, each top flap being of a width equal to half said width of bottom box structure and including a fastener assembly for connecting with said fastener assembly of said other top flap when said two top flaps are folded down into said closed position, each top flap further including a handle member that is positioned directly adjacent to said handle member of said other top flap when said when said two top flaps are folded down into said closed position;

each of said stackable box assemblies including a tray structure defining a storage compartment having sidewalls having a number of parallel divider retaining structures, a number of mating feet extending from a bottom surface thereof sized and positioned to seat against said interior top edge of a box assembly positioned below it, and a number of user moveable divider members wherein some of said divider members provided include opposed side indentations for allowing a string of Christmas lights or a garland to be wound therearound prior to inserting said ends of said divider member into two opposed parallel divider retaining structures;

a lid member securable over said top of an uppermost stackable box assembly;

said stackable box assemblies being stackable atop each other and said bottom box structure to a height equal to said height of said two rigid side flaps.

* * * * *